United States Patent [19]

Braunstein

[11] 4,128,391

[45] Dec. 5, 1978

[54] GAS REGULATOR AND GAS-FIRED TORCH ASSEMBLIES

[76] Inventor: Lee G. Braunstein, 318 Clwyd Rd., Bala Cynwyd, Pa. 19004

[21] Appl. No.: 768,464

[22] Filed: Feb. 14, 1977

[51] Int. Cl.[2] ..... F23D 13/40

[52] U.S. Cl. ..... 431/354; 137/540; 137/543.19; 239/549

[58] Field of Search ..... 137/484.4, 505.34, 505.35, 137/505.25, 540, 543.19; 239/587, 549; 266/48 ST; 31/354, 344

[56] References Cited

U.S. PATENT DOCUMENTS

| | | | |
|---|---|---|---|
| 2,935,125 | 5/1960 | Atkinson | 239/549 |
| 3,004,588 | 10/1961 | Christenson | 239/58.7 X |
| 3,192,949 | 7/1965 | De See | 137/540 |
| 3,511,266 | 5/1970 | Phlipot | 137/484.4 |
| 3,756,273 | 9/1973 | Hengesbach | 137/540 |
| 3,770,009 | 11/1973 | Miller | 137/543.19 |

*Primary Examiner*—Edward G. Favors
*Attorney, Agent, or Firm*—Beveridge, DeGrandi, Kline and Lunsford

[57] ABSTRACT

Mechanical pressure exerted by a spring on the diaphragm of a pressure regulator is adjusted by an inclined cam surface on a linearly movable slide member.

Flow of gases to a gas-fired torch is controlled by a valve which is operatively connected to an inclined cam surface on a linearly movable slide member.

A gas-fired torch assembly has a housing, a tip base extending laterally of the housing and connected thereto for swivelling movement by a connector with male and female portions. A spring retainer clip on the exterior of the female portion extends through slots in the female portion and into a circumferential groove in the male portion. Upon separation of the connector elements, a safety cutoff valve closes the gas outlet of the housing.

A burner tip base has a passage provided with a dust plug which prevents contaminants from entering the burner tip when it is detached from a torch assembly. In use, gas pressure moves the dust plug to a passage-opening position.

16 Claims, 6 Drawing Figures

GAS REGULATOR AND GAS-FIRED TORCH ASSEMBLIES

BACKGROUND AND SUMMARY

This invention relates to various improvements to gas-fired torch assemblies for welding and brazing, and also applies to gas flow control means of general utility.

With regard to gas flow control means in general, a wide variety of pressure regulators are commercially available. Many of these have a sensing chamber located in the flow path of the fluid being regulated, one wall of the chamber being formed by a peripherally supported diaphragm. A pressure spring applies mechanical force to the opposite face of the diaphragm to oppose the fluid pressure in the sensing chamber. The midportion of the diaphragm carries an actuator tube which opens and closes a control valve positioned between the source of pressurized fluid and the sensing chamber whereby the extent of valve opening is governed by the force differential across the diaphragm.

Regulators of the type discussed in the preceding paragraph have been made adjustable by providing rotatable means for adjusting the compression of the pressure spring, but such an arrangement is not practical in some instances; for example, when the regulator is on a gas-fired hand torch for brazing or welding where it is often important that the operator have one hand free to hold and manipulate the work-pieces. According to this invention, such regulators may be adjusted by one-handed operation.

Slide members with inclined valve actuating cam surfaces are known according to Phlipot, U.S. Pat. No. 3,511,266; however such prior devices have not been applied to the preferred type of pressure regulator disclosed herein, nor to gas fired torch assemblies.

According to one feature of this invention, one-handed operation of a gas-fired torch assembly is made possible by providing a valve operating means which includes a manually slidable member which is linearly movable in a direction transverse to the direction of valve movement, the manually slidable member having a cam surface inclined with respect to its axis to engage a follower operatively connected to the flow control valve. The operative connection between the cam surface and the valve may be directly against a valve stem or, in a pressure regulator device, may be against the diaphragm-biasing pressure spring where its action is opposed in part by fluid pressure on one side of a diaphragm.

In prior gas fired torches for welding, brazing and the like, there have been regulator or valve bodies which receive a laterally projecting tip base to which a welding or brazing tip is attached. Such tip bases have been mounted for swivelling movement about an axis transverse to the body, enabling a worker to keep the propane bottle or other source of liquified petroleum gas (LPG) in a somewhat upright position to prevent the discharge of liquid into the torch tip to produce flare up. Such prior devices have been constructed to permit removal of the swivelling tip base from the valve/regulator body, but they have not provided means for ensuring that no gas may be discharged after the tip base is removed. According to one feature of the present invention, there is provided in the flow path to the swivel tip base a safety cutoff valve which has a projecting actuator pin and is spring biased to a closed position.

The safety cutoff valve will remain closed whenever the swivel tip base is separated from the apparatus. However, when the swivel tip base is connected to the valve/regulator housing, it will contact the actuator pin of the cutoff valve, opening the cutoff valve to permit gas to flow to the tip base. There is also provided a spring clip retainer for holding the swivel tip base on the valve/regulator housing, the spring clip retainer connecting being known per se but being novel with respect to the field of gas-fired torches.

Another feature of the apparatus disclosed herein pertains to tip bases for gas-fired torches, specifically those tip bases which are detachably connected to a torch handle or to a valve/regulator housing. Such tip bases are provided with minute gas-releasing openings which may become clogged by small particles of contaminants such as dust, particularly if the tip base is removed from the other components of the system and is carried loosely in a toolbox. To avert this condition, the present invention involves a tip base provided with an orifice at one end, an interior passage leading through the tip base to the orifice, and a dust plug located within the passage to seal the passage from the entry of contaminating particles when the tip base is loose in a toolbox. The dust plug is movable axially of the passage between a passage-sealing position and a passage-opening position, the latter position being the closer position to the orifice. The dust plug is biased to its passage-closing position but, upon being subjected to the pressure of gas, the dust plug is movable toward the orifice to its passage-opening position which it assumes during normal use of the tip base with a burner tip attached thereto.

The inventive features discussed hereinabove may be used in a wide variety of structures, only exemplary ones being shown in the drawings and described in the following specification.

THE DRAWINGS

DESCRIPTION OF PREFERRED EMBODIMENTS

Figure 1:
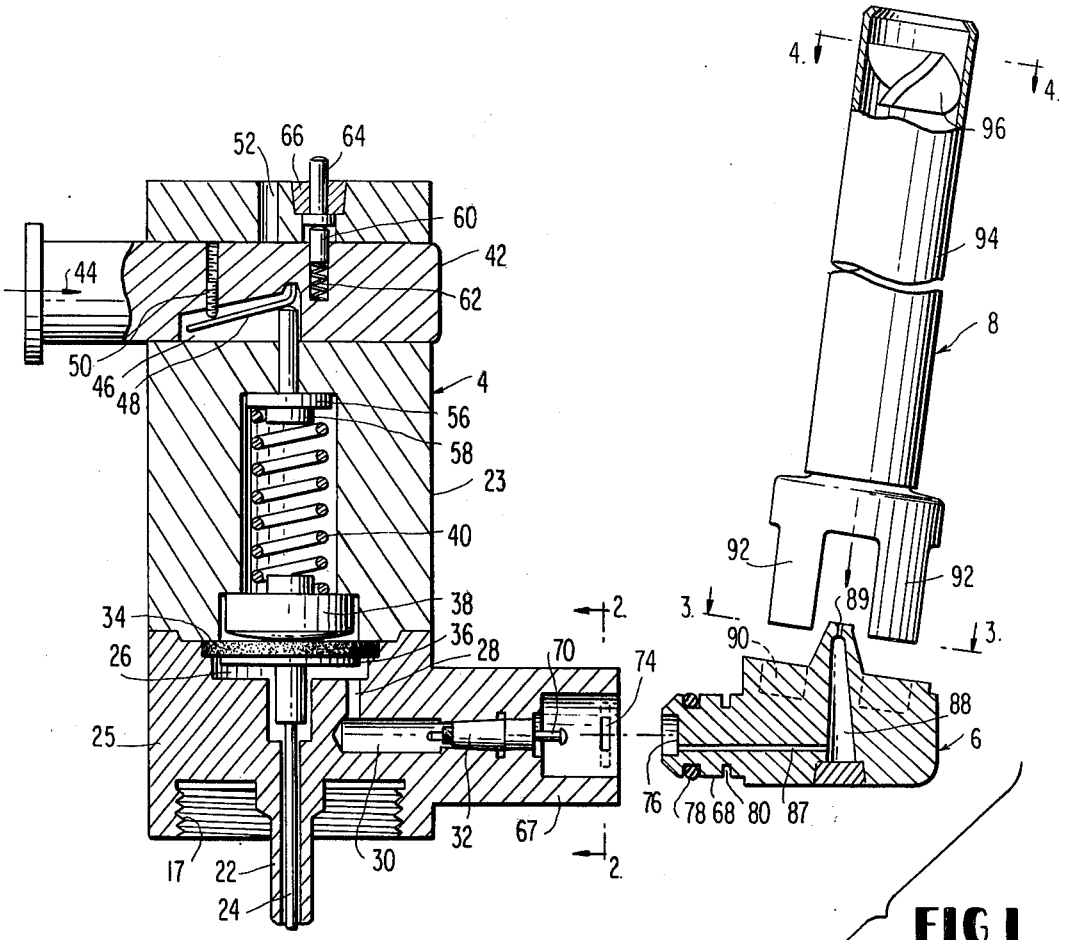
FIG. 1 is an exploded sectional view of a hand torch assembly provided with a pressure regulator constructed for one-handed operation, a detachable tip base which may be swivelled about an axis transverse to the assembly, and a safety cutoff valve which assumes a closed position when the swivel tip base is removed from the assembly.

FIG. 1 shows a preferred embodiment of the invention including a conventional one pound bottle or tank 2 of combustible fluid such as liquefied propane gas, a pressure-controlling regulator 4, a swivel tip base 6 which receives gas from the regulator 4, and a burner tip assembly 8 which is detachably connected to the tip base. Gas from the tank 2 passes through the regulator 4 and swivel tip base 6 to the burner tip assembly 8 where it is burned.

The tank 2 is of conventional construction, being provided with a standard valve assembly 10 of the type used for inflatable vehicle tires. Such valves are biased to their closed positions so that in the present instance, no combustible gases are released from tank 2 until the valve actuator pin 12 is depressed to move the valve 10 from its closed position to its intermediate or open positions. In the embodiment of FIGS. 1–4, the valve assembly 2 includes elements which serve as the control valve for gas passing through the system.

The neck 14 of tank 2 has an exteriorly threaded section 16 at its upper end for receiving mating threads 17 on the regulator 4. Within the neck 14, there is an O-ring seal 18 held in place by a plastic sleeve 20, the O-ring sealingly engaging the exterior wall of regulator inlet tube 22.

The regulator 4 is formed of an upper body section 23 and a lower body section 25, formed of Lexan polycarbonate resin and solvent bonded into a unitary body. A solid tank valve actuator rod 24 extends concentrically through the longitudinal bore in the inlet tube 22, providing an annular space between rod 24 and tube 22 for the passage of gas into the regulator body. The flow path of gas through the regulator includes a pressure chamber 26, a vertical passage 28 and a regulator outlet passage 30 which is obstructed by another tire valve assembly 32.

The tank valve actuator rod 24 is connected at its upper end to a flexible diaphragm 34 which forms one wall of the pressure chamber 26 and is therefore subjected to forces created by pressure within chamber 26. A rigid pressure distributing disc 36 is attached to the lower surface of the diaphragm 34 at the connection between the rod 24 and the diaphragm 34.

Downward forces are exerted on the diaphragm 34 by a diaphragm pressure disc 38 which is mounted on the lower end of a pressure spring 40. The downward force delivered to the diaphragm 34 by the pressure spring 40 is quite low when in the position illustrated in FIG. 1 so that the tank valve actuator rod 24 will not exert sufficient force on pin 12 to open the valving elements of tank valve 10. However, upon further compression of the spring 40, the downward force against the diaphragm 34 will be increased sufficiently to cause the diaphragm 34 and rod 24 to move the actuator pin 12 to open the valving elements in valve assembly 10. This, of course, permits the entry of gases into the pressure chamber 26 of the regulator.

The preferred means for compressing the spring 40 is a sliding cam mechanism mounted in a transverse bore in the upper part of the body of the regulator 4. This sliding cam mechanism includes a plunger or slide rod 42 movable along an axis in the path of arrow 44. A slot 46 in the rod 42 accomodates a tilt piece 48, the lower surface of which provides a cam surface inclined with respect to the axis of the sliding cam mechanism. The angular disposition of the tilt piece 48 is adjusted by a set screw 50 which is accessible for adjustment through a bore 52 in the regulator housing.

The cam surface on tilt piece 48 engages the upper end of a cam follower rod 54, the lower end of which is provided with a cap 56 and boss 58 for engaging the upper end of the pressure spring 40. Thus, it will be recognized that movement of the sliding cam mechanism in the direction indicated by the arrow 44 will cause the cam surface on tilt piece 48 to move the cam follower rod 54 downwardly, compressing the spring 40 to apply downward force on the diaphragm. When the system has been inoperative, this force will move the actuator rod 24 downwardly to open the tank valve 10. During continuous torch operations, the position of the slide rod 42 will govern the outlet pressure of the regulator due to the well-known force balancing principles as the pressure disc 38 acts downwardly on the diaphragm 34 and the gas pressure in chamber 26 acts upwardly on the diaphragm. The resultant position of the actuator rod 24 will adjust the position of the control valve elements in valve 10 to provide a substantially constant output pressure for any given position of the slide rod 42.

As a safety precaution to prevent inadvertent movement of the slide rod 42 from the illustrated inoperative position, the slide rod 42 is provided with a bore which receives a spring-loaded safety lock pin 60. This lock pin is biased upwardly by the spring 62 into a recess in the upper body 25 of the regulator housing, preventing sliding movement of the member 42. When it is desired to operate the regulator, the lock pin 60 is moved downwardly to a retracted position within the confines of the slide rod 42 which may then be moved. Such retraction of the lock pin 60 is accomplished by pressing on the exposed outer end of a release pin 64, the inner end of which presses on the upper end of the lock pin 60 to displace it to its retracted position. The release pin is retained in the housing by a bushing 66 solvent bonded to the housing.

It will be noted that the regulator does not have a return spring for the sliding cam mechanism, but instead is to be returned to its initial locked position by pressing on the exposed opposed end which is at the right end of the slide rod 42 as illustrated.

In the embodiment of FIG. 1, gas is released from the regulator 4 through a transverse extension which is coupled to the swivel tip base 6, the latter being laterally offset from the regulator 4. The coupling between the regulator body and the swivel tip base is accomplished by a female fitting 67 on the regulator body and a male fitting 68 on the swivel tip base 6.

The tire valve assembly 32 located at the bottom of the recess in fitting 67 is substantially identical to the tire valve 10, being biased to a closed position but being movable to an open position by depression of the actuator pin 70. This tire valve assembly 32 provides a safety cutoff valve as described below.

Figure 2:
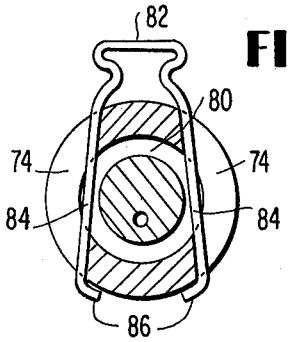
FIG. 2 is a sectional view taken along the line 2—2 in FIG. 1 with the components in their assembled condition, showing the spring clip retaining means which holds the components together and permits the swivel movement.
Figure 4:
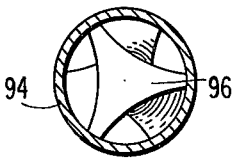
FIG. 4 is a view seen along the line 4—4 in FIG. 1, showing the face of the flame swirler at the outer end of the burner tip.

The external wall of the female fitting is provided with a pair of opposed retaining slots 74 which are best illustrated in FIG. 2, these slots extending entirely through a portion of the wall of the female fitting to provide the opening which appears in FIG. 1.

The male fitting 68 on the polycarbonate swivel tip base 6 has a valve-opening end surface 76, a circumferential slot accommodating the O-ring seal 78 and another circumferential slot 80 used to retain the male and female coupling means together. Such retention is provided by the spring clip illustrated in FIG. 2, this spring clip being positioned on the exterior of the female coupling member. The spring clip has a base 82 with depending legs 84 which extend from its opposite ends. At the lower extremity of each of the legs 84, there is an inturned foot 86 positioned to engage the exterior surface of the female coupling member to prevent inadvertent removal of the spring clip. In this position, it will be observed in FIG. 2 that a portion of the spring clip in slot 74 will lie in the slot 80 of the male member, thus preventing axial separation of the coupling formed by the male and female members.

When the swivel tip base 6 is coupled to the regulator 4, the surface 76 on the swivel tip base will depress the actuator pin 70 of valve assembly 32, enabling gas to pass into the passages 87 and 88 of the swivel tip base. At the upper end of the passage 88, there is a very small orifice 89, the size of which has been exaggerated for illustrative purposes. This jet or orifice 89 creates a reduced pressure in the flow of gas and induces the flow of combustion-supporting air into the burner tip assembly 8.

The burner tip assembly 8 is connected to and supported by the swivel tip base 6. The base 6 is provided with four sectoral recesses 90 seen in FIG. 3. Correspondingly shaped prongs 92 are located on the burner tip assembly 8 and are frictionally received in the recesses 90 to hold the burner tip in place. The spaced between the prongs 92 provide openings for the entry of air into the tube on the burner tip assembly.

Figure 5:
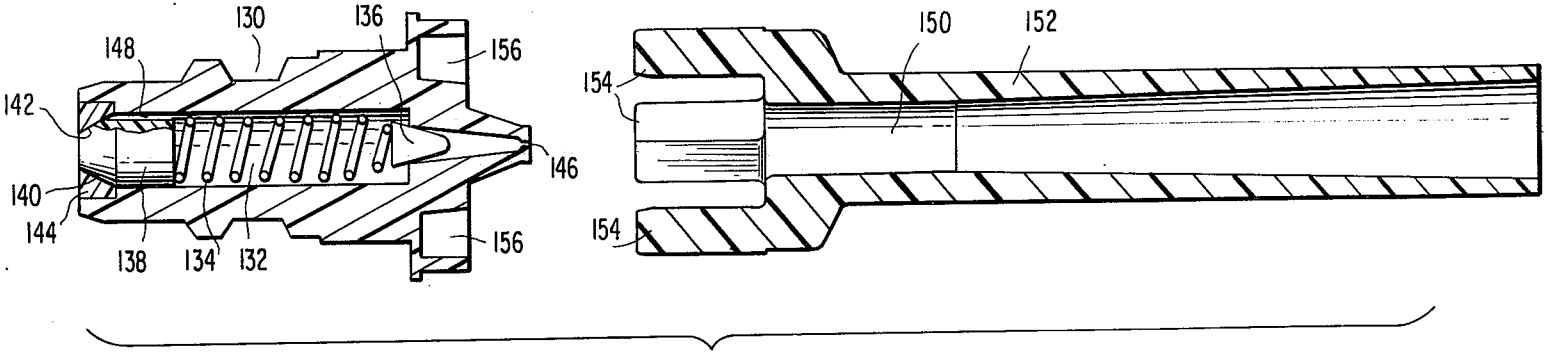
FIG. 5 is an exploded sectional view of the venturi part of a burner tip and a burner tip base provided with a dust plug.

Within the tube of the burner tip assembly 8, there is a venturi formed integrally with the prongs 92 as illustrated in the embodiment of FIG. 5. The stainless steel tube 94 is bonded to the exterior surface of the venturi and it is provided toward its outlet end with a flame swirler 96 which produces a circular flow of burning gases at the outlet end of the burner tip assembly 8. Of course, there are many types of burner tip assemblies well known in the art, and the particular construction shown herein does not constitute any portion of the invention.

Figure 6:
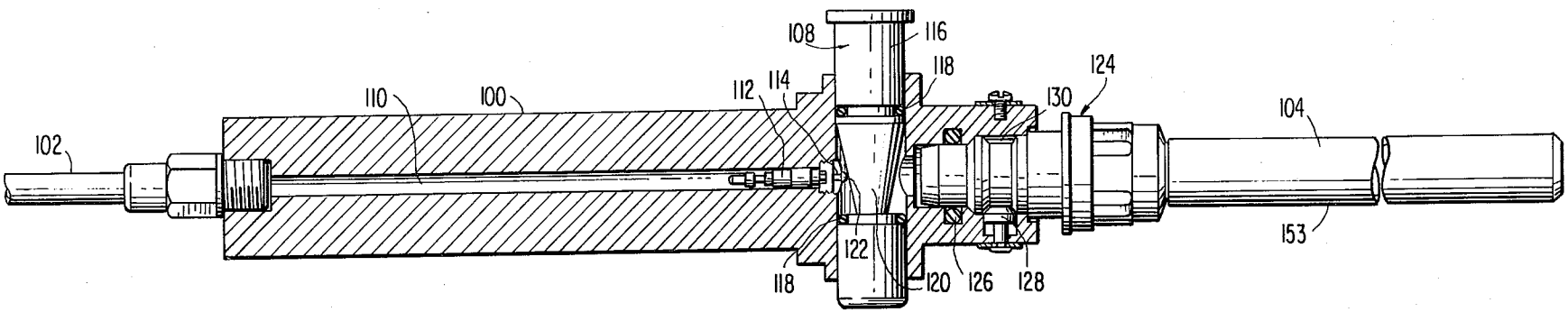
FIG. 6 is a view, partly in section, of the elements of FIG. 5 in a completed torch handle and tip assembly.

The embodiment of FIGS. 5 and 6, unlike the previously-discussed embodiment, does not utilize a pressure-sensing regulator, an adjustable cam surface nor a swivel tip base. Rather, it relates to a torch handle 100 which receives combustible gases from a source via a flexible hose 102 and delivers those gases to the burner tip 104 via a longitudinally aligned tip base 124. As in the previous embodiment, a transversely movable sliding cam mechanism 108 is used to regulate the flow of gas passing to the burner tip.

Referring to FIG. 6, it will be seen that gas from a pressurized container is carried by the hose 102 to a longitudinal bore 110 located centrally in the torch handle 100. At the left end of the bore 100, there is a tire valve assembly 112 which is like those discussed above. It is normally closed and is provided with a central actuating pin 114 which may be depressed to open the valving elements in valve assembly 112 and permit gas to flow thereby. In this manner, the valve assembly 112 provides the control valve means for gas passing through this system.

The sliding cam mechanism 108 includes a slide rod 116 which is recessed to receive O-ring seals 118. The central portion of the rod 116 has a truncated conical cam surface 120 which bears against a cam follower in the form of the head 122 of valve actuator pin 114. Of course, the position of the slide rod 116 will determine the extent of opening of valve assembly 112, the valving elements of which serve as the control valve. The pin 114 operatively connects the control valve to the follower 122.

After passing the valve 112, the gas moves around the exterior of the conical cam surface 120 and into the tip base 124. The tip base has a male portion of a quick disconnect coupling, receivable in the female end portion of the torch handle 100. A seal between the tip base and the torch handle is provided by the O-ring 126, and the tip base 124 is longitudinally retained in position by means of the spring-loaded projection 128 which engages in a correspondingly-shaped circumferential recess 130 in the tip base.

Referring to FIG. 5, it will be seen that the tip base 124 has a longitudinal passage 132 for the movement of gas from the control valve to the burner tip. Within this passage, there is a compression spring 134 which at its left end bears on a filter 136 and at its right end bears on a dust plug 138, the purpose of which is to prevent contaminants from entering the passage 132 when the tip base is in a toolbox or otherwise separated from the apparatus while not in use. The dust plug is shown in its passage-sealing position where its conical sealing surface 140 conforms to and sealingly engages the conical seat 142 located on the end plug 144 which is solvent bonded to the tip base 124. The application of gas pressure against the right end of the dust plug 138 will cause it to move to a passage-opening position leftward of its illustrated position and closer to the orifice 146 located at the outlet end of the tip base 124. The dust plug conforms generally to the shape of the interior wall of the passage 132, but its external wall is relieved to provide a longitudinal port 148 which permits gases to flow through the dust plug when the dust plug is in its passage-opening position. The gas may then proceed through the filter 136 to the orifice 146 where it is released into the throat 150 of the venturi 152. The venturi 152 extends into and is bonded to a piece of stainless steel tubing 153 which forms the exterior of the burner tip as shown at 104 in FIG. 6. A swirler of the type illustrated in FIG. 4 may be positioned in the tubing if desired.

Figure 3:
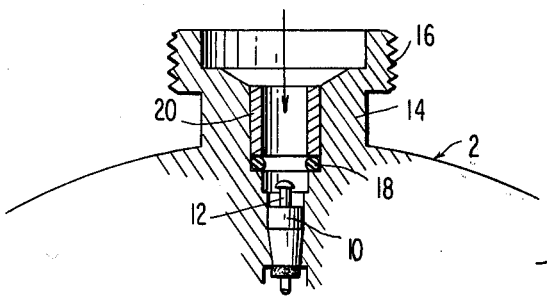
FIG. 3 is a view seen along the line 3—3 in FIG. 1, showing the tip-receiving face of the tip base.
Figure 3:
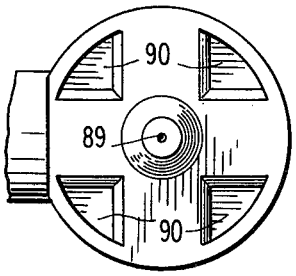

When in its assembled position as shown in FIG. 6, the burner tip 104 has its prongs 154 frictionally retained in sectoral recesses 156 in the exposed end of the tip base, the recesses 156 being identical in configuration to those shown in FIG. 3. In this embodiment, the elements 106, 138, 144, 152 and 156 are preferably formed of Lexan polycarbonate resin.

Persons familiar with the art will appreciate the advantages to be realized by adoption of the structures shown herein which are but a presently preferred embodiment. As numerous modification of and variations to these principles may be envisioned, it is emphasized that the invention is not limited only to the disclosed embodiments but is encompassing of other structures within the spirit of the claims which follow.

I claim:

1. A gas-fired torch assembly for welding, brazing and the like, comprising a burner tip for receiving and burning a combustible gas, and a flow path for carrying combustible pressurized gas to said burner tip, a manually adjustable control device located in the flow path and comprising:

a control valve biased toward a closed position and being movable through intermediate positions to an open position to vary the flow of fluid moving in said flow path, valve operating means for moving the control valve through said intermediate positions and to said open position, said valve operating means including a manually operable slide member, means for supporting said slide member for linear movement along an axis which is transverse to the direction of control valve movement, said slide member having a cam surface which is inclined with respect to said axis, and a follower means engaged with said cam surface, means supporting said follower means for movement substantially parallel to the direction of control valve movement, said follower means being in sliding contact with said cam surface, and regulator means for operatively connecting said control valve to said follower means to change the position of the control valve in response to movement of said slide member, said regulator means being constructed as follows:

a chamber in communication with the flow path, a diaphragm having one face exposed to the chamber, a pressure spring means applying mechanical force to the other face of the diaphragm, said mechanical force being directed toward said chamber to oppose forces imposed on the diaphragm by fluid pressure in said chamber, said pressure spring having its end remote from said diaphragm connected to said follower means, and actuating rod means supported on said diaphragm and operable on said control valve, said control valve being located between said source and said chamber.

2. The device of claim 1 wherein said chamber is located in a housing, a tip base extending laterally from the housing, swivel connector means detachably connecting the tip base to the housing to enable the tip base to swivel about an axis which is transverse to the housing, said swivel connector including interfitting male and female portions, said male portion having a circumferential groove, said female portion having a wall penetrated by diametrically opposed slots which are aligned with said circumferential groove, and a removable spring clip outside the female member and extending through said slots and into said groove to prevent separation of said male and female members.

3. The device of claim 2, having a cutoff valve located in the passage in said flow path in said housing and being biased to its closed position, a valve actuator pin projecting from said cutoff valve toward said swivel connector means, said valve actuator pin being depressable to open said cutoff valve, said valve actuator pin being engaged with and depressed by a portion of said swivel connector means affixed to said tip base to hold said cutoff valve in its open position until the tip base is detached from the housing to close the cutoff valve.

4. A gas-fired torch assembly for welding, brazing and the like, comprising a burner tip for receiving and burning a combustible gas, and a flow path for carrying combustible pressurized gas to said burner tip, a manually adjustable control device located in the flow path and comprising:

a control valve biased toward a closed position and being movable through intermediate positions to an open position to vary the flow of fluid moving in said flow path, valve operating means for moving the control valve through said intermediate positions and to said open position, said valve operating means including a manually operable slide member, means for supporting said slide member for linear movement along an axis which is transverse to the direction of control valve movement, said slide member having a cam surface which is inclined with respect to said axis, and a follower means engaged with said cam surface, means supporting said follower means for movement substantially parallel to the direction of control valve movement, said follower means being in sliding contact with said cam surface, and means for operatively connecting said control valve to said follower means to change the position of the control valve in response to movement of said slide member, a lock member for holding said slide member in a position where the control valve assumes its closed position, release means for moving said lock member to a retracted position to free said slide member for said linear movement.

5. The device of claim 4 wherein the retracted position of said lock pin is within said slide member, said release means having an outer end projecting from the device and an inner end for engaging the lock pin and displacing it to its retracted position.

6. The device of claim 4 in which the slide member has a longitudinally extending slot, a tilt piece located in said slot to provide said cam surface, and set screw means operable on the tilt piece for adjusting the inclination angle of said cam surface.

7. A manually adjustable control device for controlling the pressurized fluid in a flow path, comprising, a control valve biased toward a closed position and being movable through intermediate positions to an open position to vary the flow of fluid moving in said flow path, valve operating means for moving the control valve through said intermediate positions and to said open position, said valve operating means including a manually operable slide member, means for supporting said slide member for linear movement along an axis which is transverse to the direction of control valve movement, said slide member having a cam surface which is inclined with respect to said axis, and a follower means engaged with said cam surface, means supporting said follower means for movement substantially parallel to the direction of control valve movement, said follower means being in sliding contact with said cam surface, and means for operatively connecting said control valve to said follower means to change the position of the control valve in response to movement of said slide member, regulator means operatively connecting the control valve to the follower, said regulator means including, a chamber in communication with the flow path, a diaphragm having one face exposed to the chamber, a pressure spring means applying mechanical force to the other face of the diaphragm, said mechanical force being directed toward said chamber to oppose forces imposed on the diaphragm by fluid pressure in said chamber, said pressure spring having its end remote from said diaphragm connected to said follower means, and actuating rod means supported on said diaphragm and operable on said control valve, said control valve being located between said source and said chamber.

8. A gas-fired torch assembly for welding, brazing and the like, comprising, a housing which includes a passage for gases, a tip base extending laterally from the housing, swivel connector means detachably connecting the tip base to the housing to enable the tip base to swivel about an axis which is transverse to the housing, said swivel connector including interfitting male and female portions, said male portion having a circumferential groove, said female portion having a wall penetrated by diametrically opposed slots which are aligned with said circumferential groove, and a removable spring clip outside the female member and extending through said slots and into said groove to prevent separation of said male and female members.

9. The torch assembly of claim 8 wherein said spring clip has a base, a pair of legs each extending from an opposite side of the base, and inturned retainer feet at the ends of each of said legs, said retainer feet lying outside said slots and engaging the exterior wall of the female member.

10. The torch assembly of claim 8 including a container of pressurized combustible gas connected to said housing and having an outlet opening in communication with said passage, and a burner tip connected to and extending from said tip base.

11. A gas-fired torch assembly for welding, brazing and the like, comprising, a tip base provided with an orifice at one end, an interior passage leading through the tip base to the orifice, a dust plug located within the passage to seal the passage from the entry of contaminating particles, said dust plug being movable axially within the passage between a passage-sealing position and a passage-opening position, said passage-opening position being closer to the orifice than said passage-sealing position, a compression spring located within the passage for biasing the dust plug to its passage-closing position, said dust plug being movable toward the orifice to its passage-opening position when pressure is exerted thereon by gas flowing toward said passage and said orifice, and a filter located between said orifice and said spring, said spring bearing on said filter to hold said filter in position.

12. The torch assembly of claim 11 wherein said dust plug has a conical sealing surface, a conical seat at the end of the passage remote from said orifice, said sealing surface conforming to said seat when the dust plug is in its passage-sealing position, said dust plug inwardly of said sealing surface conforming to the cross section of said passage and being provided with a longitudinal port for the passage thereby of gas when the dust plug is in its passage-opening position.

13. A gas fired torch assembly for welding, brazing and the like, comprising, a housing which includes a passage for gases, a tip base extending laterally from the housing, swivel connector means detachably connected the tip base to the housing to enable the tip base to swivel about an axis which is transverse to the housing, a cutoff valve located in the passage in said housing and being biased to its closed position, a valve actuator pin projecting from said cutoff valve toward said swivel connector means, said valve actuator pin being depressable to open said cutoff valve, said valve actuator pin being engaged with and depressed by a portion of said swivel connector means affixed to said tip base to hold said valve in its open position until the tip base is detached from the housing to close the cutoff valve.

14. A gas-fired torch assembly for welding, brazing and the like, comprising a burner tip for receiving and burning a combustible gas, and a flow path for carrying combustible pressurized gas to said burner tip, a manually adjustable control device located in the flow path and comprising:

a control valve biased toward a closed position and being movable through intermediate positions to an open position to vary the flow of fluid moving in said flow path, valve operating means for moving the control valve through said intermediate positions and to said open position, said valve operating means including a manually operable slide member, means for supporting said slide member for linear movement along an axis which is transverse to the direction of control valve movement, said slide member having a cam surface which is inclined with respect to said axis, and a follower means engaged with said cam surface, means supporting said follower means for movement substantially parallel to the direction of control valve movement, said follower means being in sliding contact with said cam surface, and means for operatively connecting said control valve to said follower means to change the position of the control valve in response to movement of said slide member, said means for operatively connecting said control valve to said follower means being a direct physical connection between said valve and said follower means whereby there is no relative movement between the valve and the follower means, a tip base provided with an orifice at one end, an interior passage leading through the tip base to the orifice, a dust plug located within the passage to seal the passage from the entry of contaminating particles, said dust plug being movable axially within the passage between a passage-sealing position and a passage-opening position, said passage-opening position being closer to the orifice than said passage-sealing position, means for biasing the dust plug to its passage-closing position, said dust plug being movable toward the orifice to its passage-opening position when pressure is exerted thereon by gas flowing toward said passage and said orifice.

15. A gas-fired torch assembly for welding, brazing and the like, comprising a burner tip for receiving and burning a combustible gas, and a flow path for carrying combustible pressurized gas to said burner tip, a manually adjustable control device located in the flow path and comprising:

a control valve biased toward a closed position and being movable through intermediate positions to an open position to vary the flow of fluid moving in said flow path, valve operating means for moving the control valve through said intermediate positions and to said open position, said valve operating means including a manually operable slide member, means for supporting said slide member for linear movement along an axis which is transverse to the direction of control valve movement, said slide member having a cam surface which is inclined with respect to said axis, and a follower means engaged with said cam surface, means supporting said follower means for movement substantially parallel to the direction of control valve movement, said follower means being in sliding contact with said cam surface, means for adjusting the inclination angle of said cam surface, and means for operatively connecting said control valve to said follower means to change the position of the control valve in response to movement of said slide member.

16. A gas-fired torch assembly for welding, brazing and the like, comprising a burner tip for receiving and burning a combustible gas, and a flow path for carrying combustible pressurized gas to said burner tip, a manually adjustable control device located in the flow path and comprising:

a control valve biased toward a closed position and being movable through intermediate positions to an open position to vary the flow of fluid moving in said flow path, valve operating means for moving the control valve through said intermediate positions and to said open position, said valve operating means including a manually operable slide member having a longitudinally extending slot, means for supporting said slide member for linear movement along an axis which is transverse to the direction of control valve movement, said slide member having a tilt piece in said slot to provide a cam surface which is inclined with respect to said axis, set screw means operable on the tilt piece for adjusting the inclination angle of the cam surface, and a follower means engaged with said cam surface, means supporting said follower means for movement substantially parallel to the direction of control valve movement, said follower means being in sliding contact with said cam surface, and means for operatively connecting said control valve to said follower means to change the position of the control valve in response to movement of said slide member.

* * * * *